US010561912B2

(12) United States Patent
Gait

(10) Patent No.: US 10,561,912 B2
(45) Date of Patent: Feb. 18, 2020

(54) APPARATUS AND METHOD FOR STRINGING TRADITIONAL POCKETS WITHIN A LACROSSE STICK HEAD

(71) Applicant: Paul Gait, Attamont, NY (US)

(72) Inventor: Paul Gait, Attamont, NY (US)

( * ) Notice: Subject to any disclaimer, the term of this patent is extended or adjusted under 35 U.S.C. 154(b) by 0 days.

(21) Appl. No.: 15/817,549

(22) Filed: Nov. 20, 2017

(65) Prior Publication Data

US 2018/0140914 A1 May 24, 2018

Related U.S. Application Data

(60) Provisional application No. 62/423,990, filed on Nov. 18, 2016.

(51) Int. Cl.

| | |
|---|---|
| ***A63B 59/20*** | (2015.01) |
| ***A63B 51/00*** | (2015.01) |
| ***A63B 60/50*** | (2015.01) |
| ***A63B 102/14*** | (2015.01) |

(52) U.S. Cl.

CPC ..... *A63B 59/20* (2015.10); *A63B 51/00* (2013.01); *A63B 60/50* (2015.10); *A63B 2102/14* (2015.10)

(58) Field of Classification Search

CPC ..... A63B 59/20; A63B 60/50; A63B 51/00; A63B 2102/01; A63B 2102/14

See application file for complete search history.

(56) References Cited

U.S. PATENT DOCUMENTS

| | | | | |
|---|---|---|---|---|
| 6,723,134 | B2 * | 4/2004 | Tucker, Sr. | A63B 49/022 473/513 |
| 7,445,571 | B2 * | 11/2008 | Winningham | A63B 60/42 473/513 |
| 7,727,092 | B2 * | 6/2010 | Lignelli | A63B 59/20 473/513 |
| 2011/0160007 | A1 * | 6/2011 | Winningham | A63B 59/20 473/513 |

* cited by examiner

*Primary Examiner* — Jeffrey S Vanderveen

(74) *Attorney, Agent, or Firm* — Scarinci Hollenbeck, LLC; Libby Babu Varghese

(57) ABSTRACT

An apparatus for stringing a traditional lacrosse pocket, comprising a substantially rectangular and concave shaped pocket form sized to fit inside a lacrosse head, a series of notches running along the longitudinal edges of the pocket form, a series of cutouts running along the longitudinal center of the pocket form, outside runner guides positioned in-between the notches along the longitudinal edges of the pocket form and a pair of middle runner guides positioned in-between each of the cutouts running along the longitudinal center of the pocket form, each of the pair of the pair of middle runner guides positioned on opposite sides of the longitudinal center.

1 Claim, 7 Drawing Sheets

APPARATUS AND METHOD FOR STRINGING TRADITIONAL POCKETS WITHIN A LACROSSE STICK HEAD

This Application claims priority to Provisional Patent Application 62/423,990 filed on Nov. 18, 2016.

FIELD OF THE INVENTION

This disclosure relates generally to an apparatus and method for stringing traditional pockets for a lacrosse stick. The apparatus comprises a plurality of guides that hold thongs typically used in a traditional pocket of a lacrosse stick at any depth desired by a user and guides the user in the nylon placement during stringing. The guides can also be used to produce a variety of different shaped pockets. The apparatus and method greatly decrease the skill required to install a high quality traditional pocket in a lacrosse stick. The apparatus and method also increase the consistency in the shape of the pocket. For example, the apparatus and method enable the user to replicate the same pocket for numerous lacrosse sticks because the form controls the depth of the thongs and the nylon placement during all steps of stringing into the lacrosse head. Once the stringing of the pocket is completed the flexible or removable runner holders allow the form to be removed from the lacrosse head. In other words, the apparatus and method remove the most influential variables associated with the installation of a traditional lacrosse pocket during all steps of installation.

BACKGROUND

Over the last thirty years the number of people playing lacrosse has increased dramatically. Today, in some locations, youth lacrosse is as popular as little league baseball and college teams are drawing over 30,000 people to a single game. Moreover, two professional leagues have been formed with teams in many of the largest cities around the United States and Canada.

As the sport has grown, the quality of play has also improved. Players are faster, stronger, and more skilled than ever before. Today, it is not uncommon for players to shoot a lacrosse ball in excess of 100 mph or pass behind their back with pin-point accuracy. As a result, players are demanding more of their equipment. The old hand carved wooden sticks are no longer used for playing the sport.

To satisfy this demand, companies have improved the design of lacrosse sticks. The old wooden sticks have been replaced by the combination of aluminum or titanium handle and a plastic head. The new handles and heads are designed to decrease the stick's weight, increase its durability, and improve its overall performance. However, no one has designed an efficient apparatus or method for stringing a traditional pocket for a lacrosse stick let alone stringing a high quality traditional pocket consistently.

People have tried to improve the quality of the pockets by stringing the pockets with different materials or in different patterns, but none of these ideas have succeeded. For example, in men's lacrosse, mesh pockets were created as an alternative to traditional pockets. The main advantage of a mesh pocket is the ease of stringing and the consistent shape. These advantages have allowed the mesh pocket to become the norm in the men's game. However, mesh style pockets are not allowed for women's play. As a result, there is still a need to improve the ease of stringing a traditional style pocket with a consistent shape.

To obtain a quality lacrosse pocket, lacrosse players must buy the materials for a pocket separately from the stick and pay an expert to install the pocket as the pockets sold at retail stores are strung inconsistently (i.e., the nylon placement, tension, depth, and shape of the pocket are random). If a lacrosse player does not know an expert, they must suffer the consequences of using a pocket which provides inadequate ball control, passing accuracy, and shooting speed. In addition, even an expert cannot string the same pocket twice in the same way. Thus, every time a player uses a new pocket, it takes several weeks to become familiar with how that particular pocket passes and shoots. These inconsistent pockets are a significant problem because lacrosse sticks frequently break during the middle of a game.

What is needed is an apparatus and method for stringing a traditional lacrosse pocket easily and consistently. Further, what is further needed is an apparatus and method for stringing a traditional lacrosse pocket without requiring an expert. Further, what is needed is an apparatus that allows traditional lacrosse pockets to be mass produced and inventoried so that they are ready for quick installation. Lastly, what is needed is an apparatus and method for stringing a traditional lacrosse pocket that can be mass-produced and easily installed into the lacrosse head, to satisfy the growing demand.

SUMMARY OF THE INVENTION

The present invention is a new apparatus and method for stringing traditional pockets for a lacrosse stick. The present invention uses a plurality of guides to hold the runner/thongs used in a traditional pocket at the depth dictated by the molded shape of the runner guides and notch locations. The guides and the notch locators of the present invention do not change to create a very consistently shaped lacrosse pocket. Thus, the present invention greatly decreases the skill required to string a high quality traditional lacrosse pocket with or without the lacrosse head.

The present invention also increases the consistency in the shape of the pocket. For example, if someone strings a traditional pocket with the present invention, the present invention enables the user to replicate the same pocket because the depth of the runner/thongs and the nylon placement are controlled. In other words, the present invention removes the most influential variables associated with the installation of a traditional lacrosse pocket.

The present invention also improves the ease of stringing most of the pocket with the exception of that portion that anchors the pocket to the head. The pocket can be strung onto the form and then stored for installation into the head at a later time. This allows for mass-production of pre-strung pockets. Moreover, the molded form holds the pocket in shape preventing shrinking and distortion during storage.

The present invention also improves the ease and speed of stringing a pre-strung traditional style pocket into a lacrosse head. The molded pocket form consisting of flexible or removable runner/thong guide holders, allow the pre-strung pocket to be held to the molded form while being strung into a lacrosse head. The runner/thong holders securely anchor and align the top and bottom of each runner with the corresponding stringing holes of the lacrosse head, reducing time and difficulty of securing the pocket to the top and bottom of the lacrosse head. With the top and bottom of the runners securing the pocket and pocket form in the correct shape the outside runners can easily be aligned and strung to the side wall lace or stringing holes of the lacrosse head. Once the pocket is completely strung into the lacrosse head, the flexible or removable runner/thong holders allow the form to be released, from the head, leaving a consistent preformed pocket.

The present invention will allow non-expert and expert stringers to have an inventory of partially completed traditional pockets on hand and be able to string them into any lacrosse head in less than half the time normally required.

As a result, lacrosse players and retailers will no longer have to rely on expert stringers, who can be inconsistent and slow when stringing. Using the present invention, any person can consistently string high quality pockets in a speedy and consistent fashion. The present invention works with any type of lacrosse head.

BRIEF DESCRIPTION OF THE DRAWINGS

This disclosure is further described in the detailed description that follows, with reference to the drawings, in which.

DETAILED DESCRIPTION

An exemplary embodiment of an apparatus and method for stringing traditional pockets within a lacrosse stick head is disclosed. As required, detailed embodiments of the present invention are disclosed herein however, it is to be understood that the disclosed embodiments are merely exemplary of the invention that may be embodied in various and alternative forms. The figures are not necessarily to scale and some features may be exaggerated or minimized to show details of particular components. Therefore, the structural and functional details disclosed herein are not to be interpreted as limiting, but merely as a representative basis for teaching one skilled in the art to variously employ the present invention.

Figure 1A:
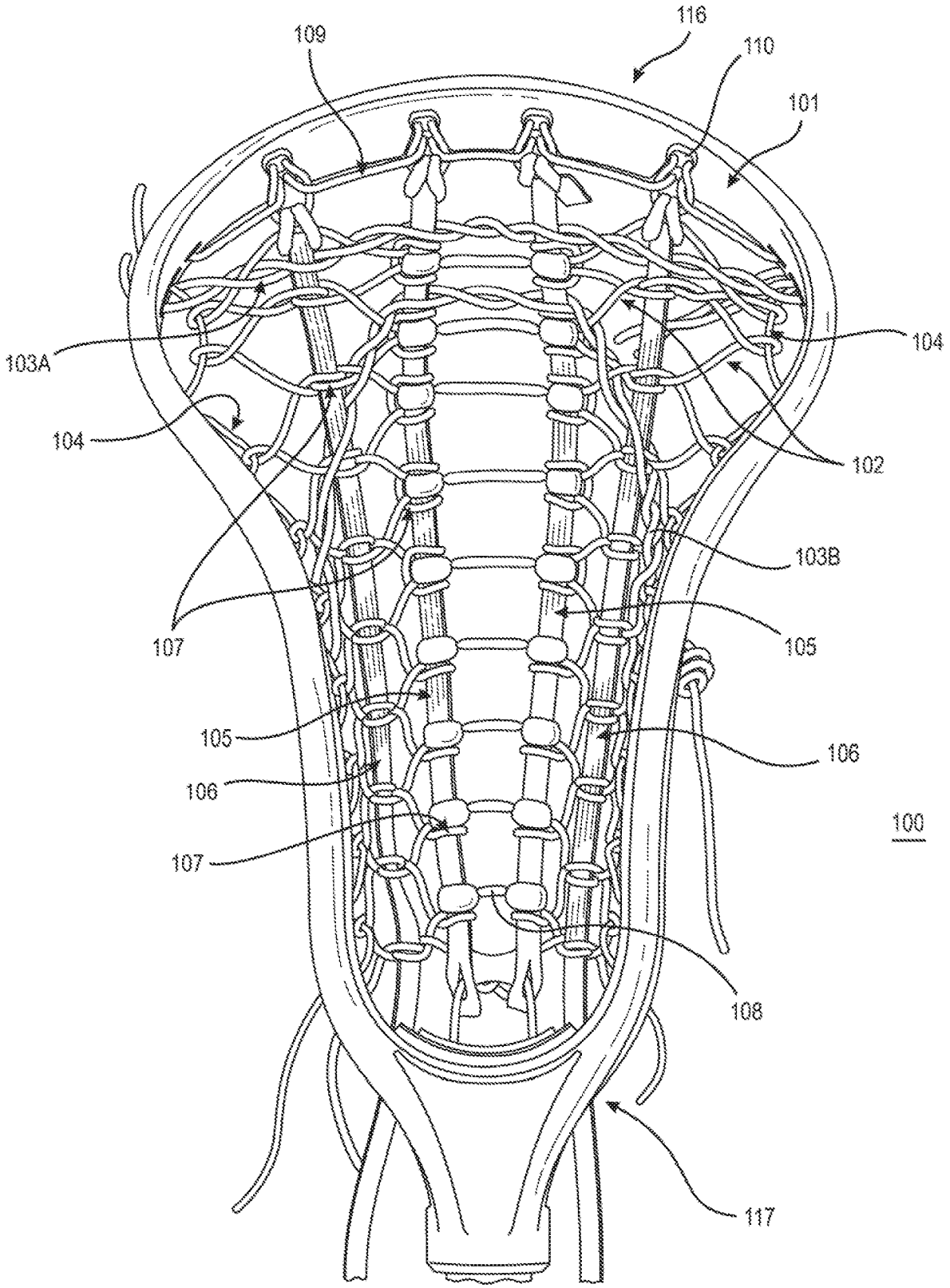
FIG. 1A is a front view of a lacrosse stick head strung with a traditional pocket.

In FIG. 1A, a front view of a lacrosse stick head strung with a traditional pocket is shown. As shown in FIG. 1A, the traditional pocket 100 strung within the head 101 of a lacrosse stick includes lacing strings 102, shooting strings 103A and 103B, side wall laces 104, inner runners 105 and outer runners 106.

The lacing strings 102 are interlaced with and knotted to the inner and outer runners 105 and 106 at specific locations 107 across the entire area of the traditional pocket 100 and are preferably made of nylon. However, a variety of other man made or natural materials with similar pliability and strength may also be used while remaining within the scope of the present disclosure.

The inner runners 105 run the longitudinal length of the traditional pocket 100 from the top of the head 116 to the bottom of the head 117, the inner runners 105 being positioned near the longitudinal center of the traditional pocket 100. The inner runners 105 are connected using multiple individual lacing strings 108 that are generally evenly spaced along the length of the inner runners 105.

Similarly, the outer runners 106 also run the longitudinal length of the traditional pocket 100 from the top of the head 116 to the bottom of the head 117, the outer runners 106 being positioned near the outer edges of the head 101 and are preferable made of leather. However, a variety of other man made or natural material with similar pliability and strength may also be used while remaining within the scope of the present disclosure, including nylon.

The top and bottom shooting strings 103A and 103B are interlaced within the lacrosse pocket to assist in the adjustment of the release angle of the pocket. Typically, the tighter the shooting strings 103A and 103B, the greater the release angle. The bottom shooting string 103B is always looser than the top shooting string 103A and can be woven to form a curved U shape. This U shape prevents the ball from moving side to side when shooting or passing.

The side wall laces 104 are used as another method of adjusting the depth of the lacrosse pocket. One can loosen the sidewall laces 104 to increase the overall depth of the pocket 100 or tighten to decrease the depth of the pocket 100.

The upper lateral edge at the top of the head 116 include four evenly spaces scoops 110 used to secure the inner and outer runners 105 and 106 to the head 101 using a top lace 109.

Figure 1B:
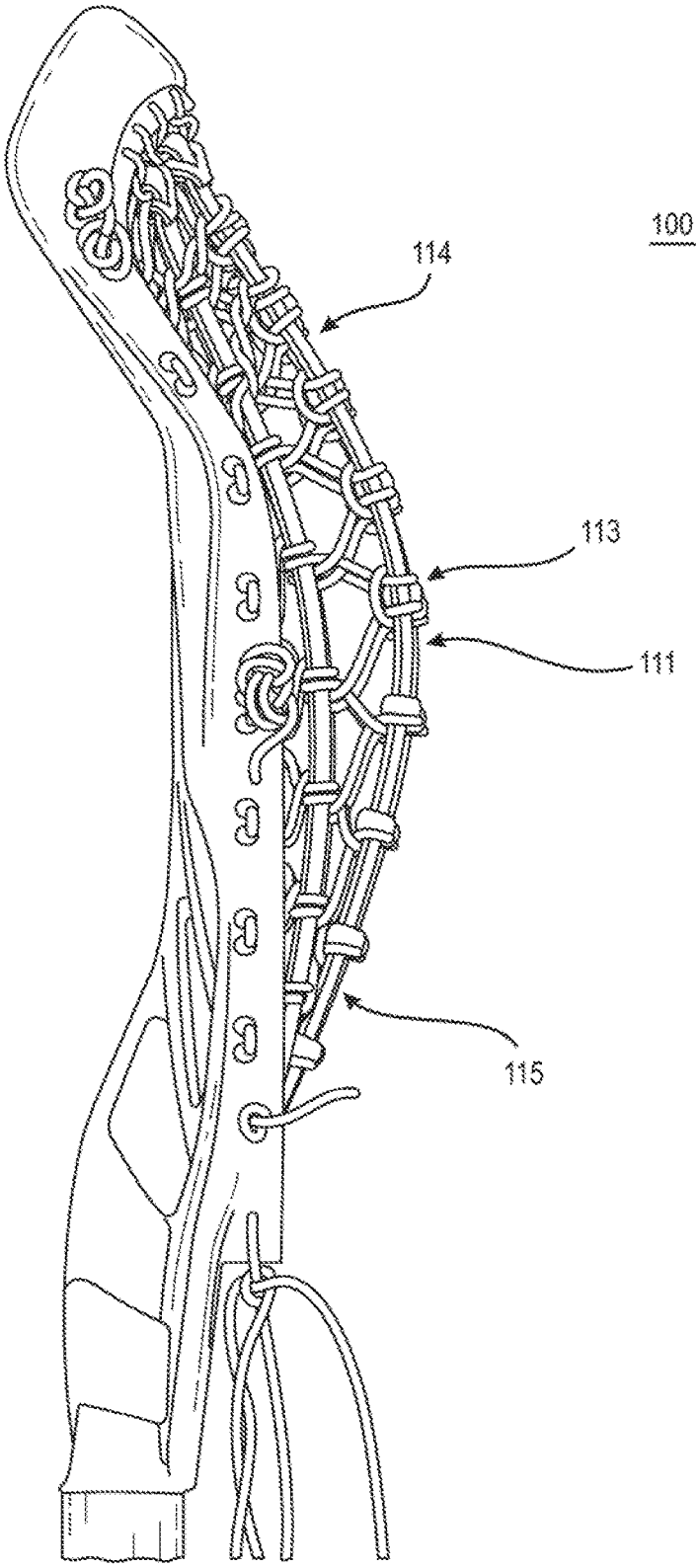
FIG. 1B is a side view of a lacrosse stick head strung with a traditional pocket.

In FIG. 1B, a side view of a lacrosse stick head strung with a traditional pocket is shown. As shown in FIG. 1B, the traditional pocket 100 has a defined shape and depth to accommodate a standard lacrosse ball. The pocket 100 can be strung with different tensions and shapes to create a defined low spot 111 within the pocket 100. In the past, players have had the low spot 111 closer to the ball stop area 115 of the lacrosse head 101. In today's game, players are using pockets that have a defined low spot 111 in the middle 113 or upper 114 areas of the lacrosse head 101. FIG. 1B shows a defined low spot 111 in the middle portion 113 of the head 101.

Figure 2A:
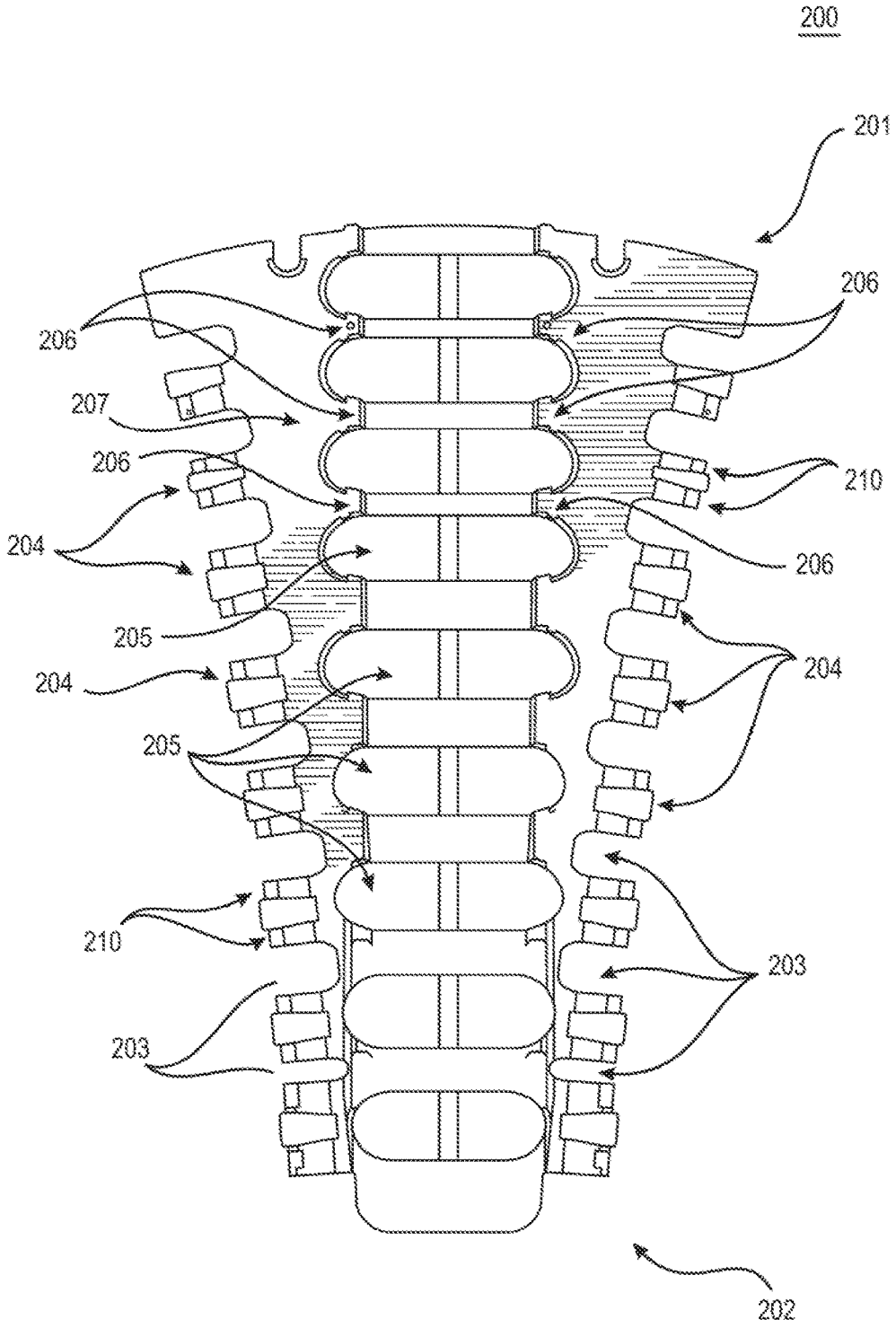
FIG. 2A is a front view of a pocket form.

In FIG. 2A, a front view of a pocket form is shown. As shown in FIG. 2A, the pocket form 200 has a tapered rectangular shape, the shape evenly tapering from a wider upper end 201 to a lower narrower end 202 that is approximately two inches narrower than the upper end 201. The longitudinal length of the pocket form 200 is approximately equal to two and half times the width of the wider upper end 201.

As further shown in FIG. 2A, a series of evenly spaced notches 203 are cut out along the entire length of each longitudinal edge of the pocket form 200. An outer runner guide 204 is positioned in between each of the notches 203, each outer runner guide 204 rising upward from an upper surface 207 of the pocket form 200 and outward towards a corresponding longitudinal edge.

A retaining clip 210 is position on each side of each outer runner guide 204. Each retaining clip 210 extending outward from a corresponding longitudinal edge and including an upward rising tab that reaches the bottom surface of its corresponding outer runner guide 204.

Each outer runner guide 204 and its surrounding retaining clips 210 are flexible as to allow for the insertion, retention and eventual removal of the an outer runner 106 while stringing the pocket 100.

In another embodiment, the outside running guides 204 are removably attached to the surface upper surface 207 of the pocket form 200.

As further shown in FIG. 2A, a series of inner cutouts 205 are evenly position on each side of and running along the full length of the longitudinal center of the pocket form 200. An inner runner guide 206 is positioned in between each of the inner cutouts 205 on each side of the longitudinal center of the pocket form 200, each inner runner guide 206 rising upward from the upper surface 207 of the pocket form 200.

The pocket form 200 may be made of any semi-rigid material including metal, wood, plastic or any other material know to a person of reasonable skill in the art.

Figure 2B:
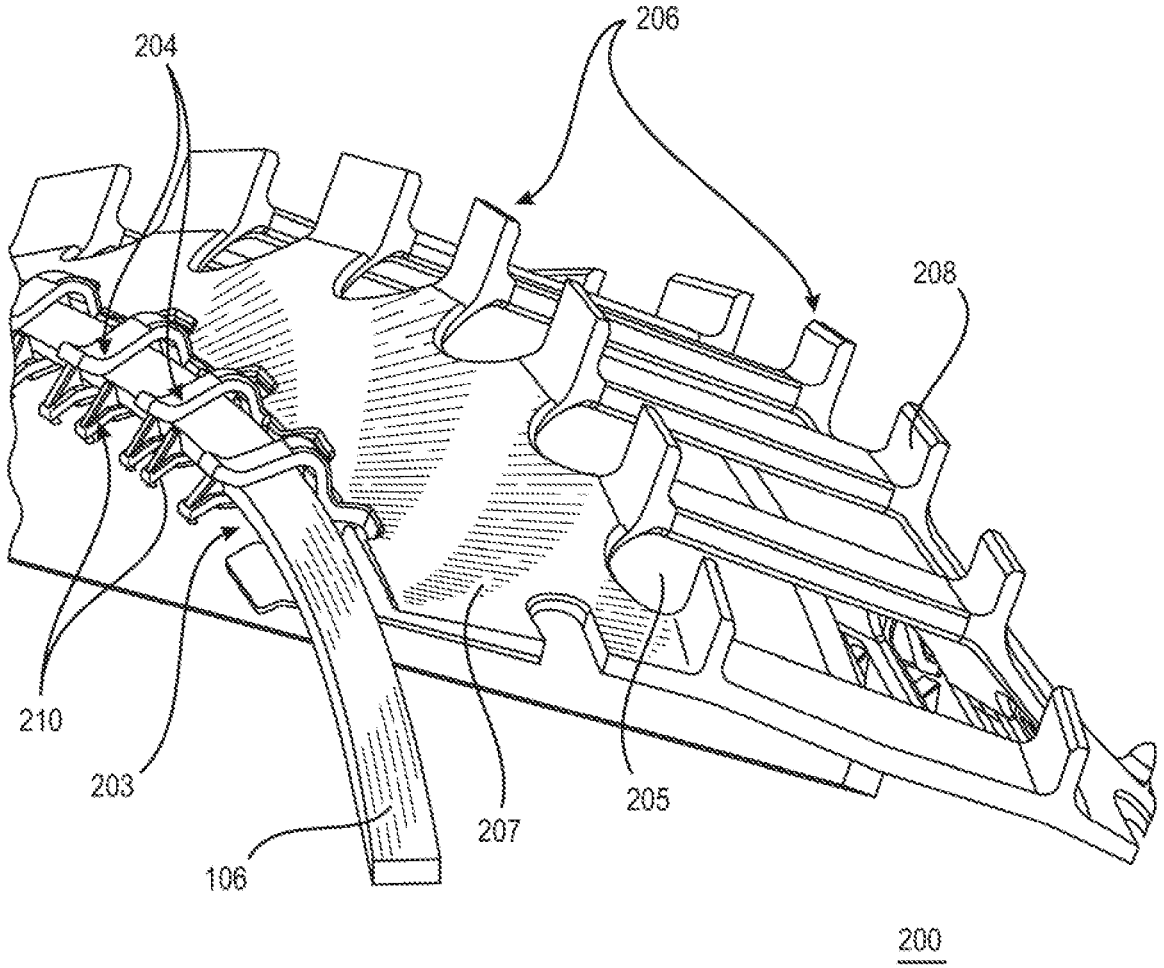
FIG. 2B is a side view of the pocket form.

In FIG. 2B, a side view of the pocket form is shown. As shown in FIG. 2B, the pocket form 200 is concave shaped along its longitudinal length. The curve created by this concave shape helps facilitate the creation of a traditional pocket 100 with a consistent shape and depth.

As also shown in FIG. 2B, the outer runner guides 204 and the retaining clips 210 interact to define a space in which an outer runner 106 may be inserter and temporality retained as to follow the concave shape of the pocket form 200.

Similarly, the inner runner guides 206 follow the same concave shape as they extend upward from the surface 207 of the pocket form 200.

Figure 3:
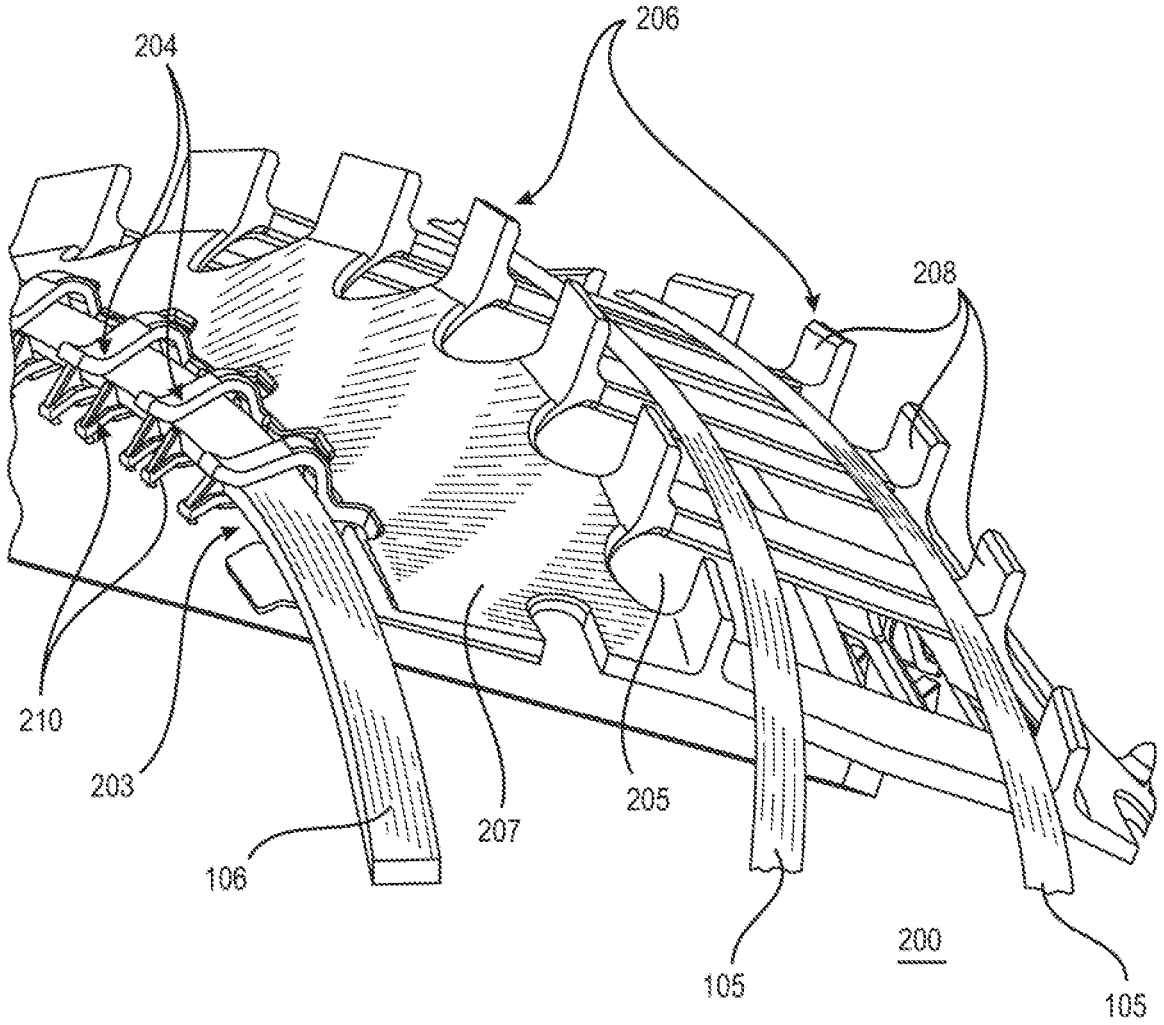
FIG. 3 is a perspective view of the pocket form showing the placement of runners within the pocket form.

In FIG. 3, a perspective view of the pocket form showing the placement of runners within the pocket form is shown. As shown in FIG. 3, an outer runner 106 is securely placed within the spaces defined by the outer runner guides 204 and their corresponding retaining clips 210 along each longitudinal side of the pocket form 200.

As further shown in FIG. 3, an inner runner 105 is placed over the inner cutouts 205 and positioned up against an inner surface 208 of each of the inner runner guides 206 on each side of the longitudinal center of the pocket form 200.

Figure 4:
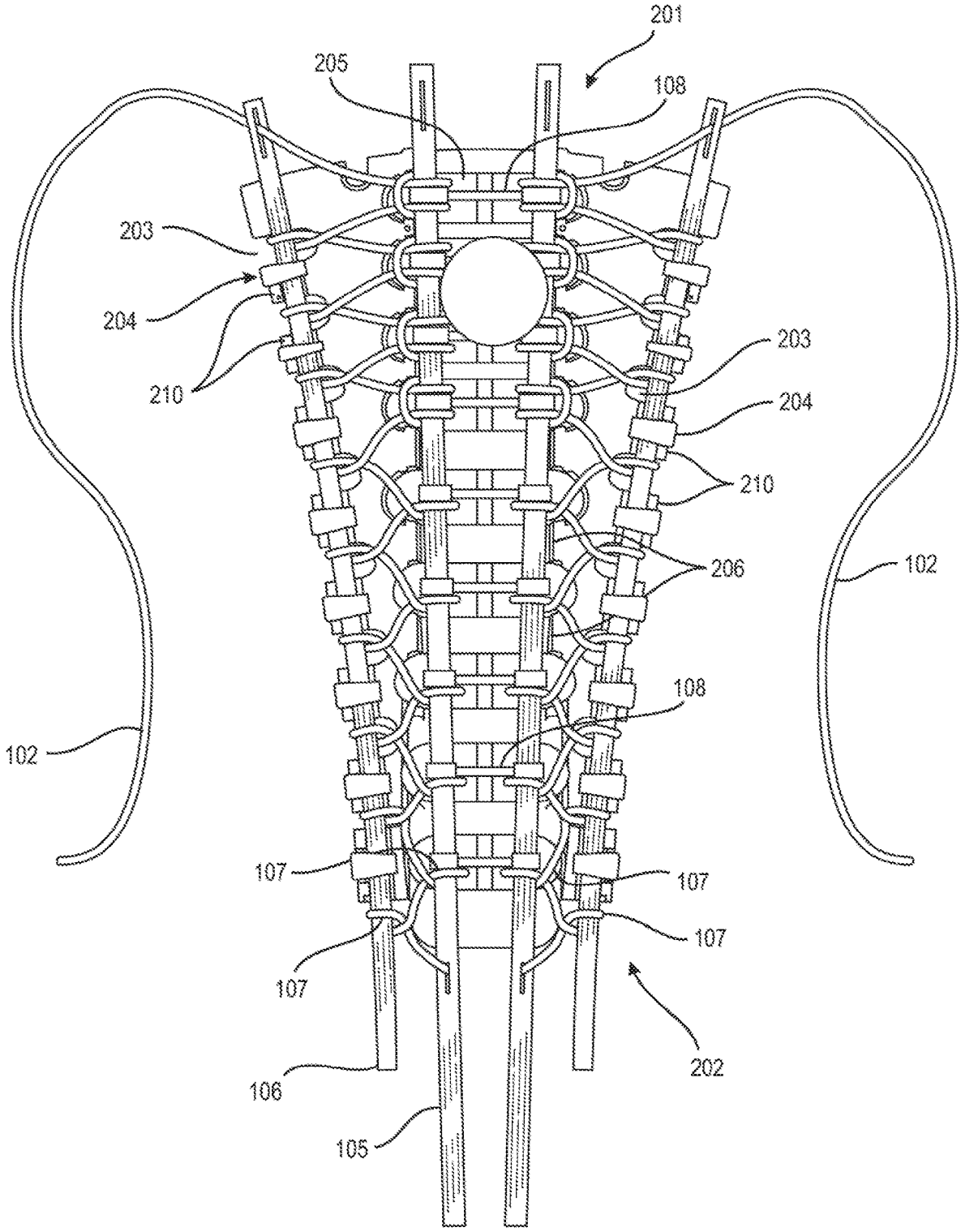
FIG. 4 is a perspective view of the pocket form showing the interlacing and knotting of the lacing string within the pocket form.

In FIG. 4, a front view of the pocket form showing the interlacing and knotting of the lacing string within the pocket form is shown. As shown in FIG. 4, a lacing string 102 is interlaced with and knotted in a crisscross fashion to the outer and inner runners 105 and 106 positioned on each longitudinal side of the pocket form 200. The interlace and knotting positions 107 on the inner and outer runners 105 and 106 are defined by the inner cutouts 205 running along the longitudinal center of the pocket form 200 and the notches 203 running along the longitudinal edges of the pocket form 200. Specifically, the lacing string 102 is initially interlaced around the outer runner 106 at a first notch 203 position starting from the narrower lower end 202 of the pocket form 200. The lacing string 102 is then knotted around the inner runner 105 at the first inner cutout 205 position starting from the narrower lower end 202 of the pocket form 200. This continues on to the second notch 203 position 107 on the longitudinal edge and the second inner cutout 205 position 107 and so on upward towards the larger upper end 201 of the pocket form 200.

As shown in FIG. 4, the notches 203 and inner cutouts 2054 are positioned and spaced along the longitudinal length of the pocket forms 200 as to form a diamond shaped weave with the lacing strings 102 interleaved and knotted to the inner and outer runner 105 and 106 on each longitudinal side of the pocket form 200. However, in another embodiment, the notches 203 and inner cutouts 205 may be positioned and spaced as to form a square shaped weave or a weave of any other shape. Moreover, the notches 203 and inner cutouts 205 may be unevenly spaced such as to form a combination of weave patterns or random weave patterns using the lacing strings 102.

As further shown in FIG. 4, the inner runners 105 are attached to each other using individual lacing strings 108, the ends of each individual lacing string 108 knotted to an inner runner 105 on each side of the longitudinal center at positions defined by each of the inner cutouts 205.

In another embodiment, the spacing of the notches 203 running along the longitudinal edges of the pocket form 200 may be varied as to accommodate interlacing at different positions on the outer runners 106 alone. Similarly, the spacing of the inner cutouts 205 may be varied to accommodate knotting at different positions on the inner runners 105 alone. The spacing between the notches 203 may also be varied to accommodate the formation of different lacrosse pocket shapes.

Figure 5:
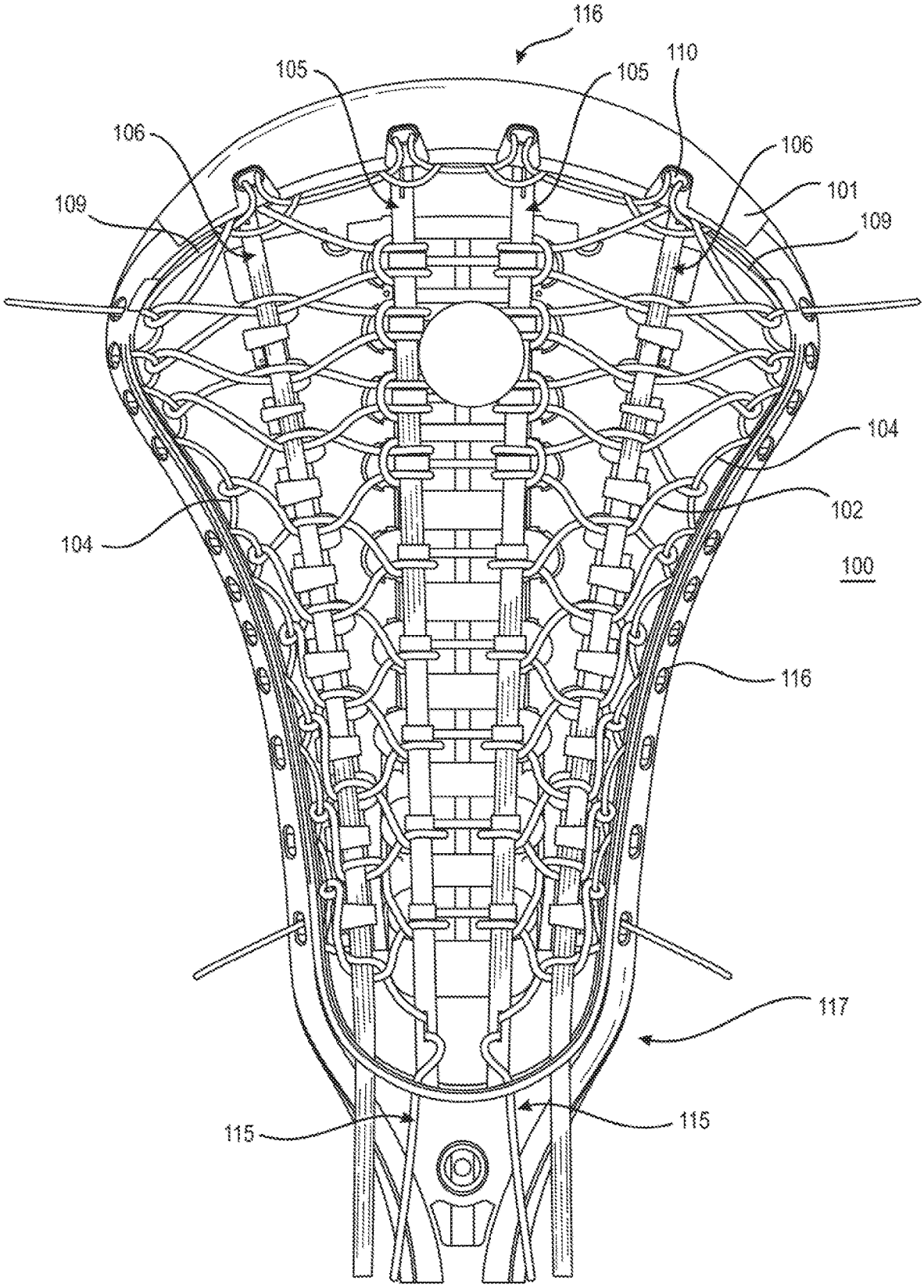
FIG. 5 is a back view of the head of the lacrosse stick with a traditional pocket strung using the pocket form.

FIG. 5 is a back view of the head of the lacrosse stick with a traditional pocket strung using the pocket form. As shown in FIG. 5, the pocket form with a pre-strung pocket 100 can quickly be installed into a lacrosse head 101 by first securing an upper end of the inner and outer runner 105 and 106 to a corresponding scoop 110 positioned along the top portion 116 of the lacrosse head 101 using a top lace 109. Next, the bottom end of the outer and inner runners 105 and 106 can be laced through ball stop holes 115 located at the bottom portion 117 of the head 101. The cross lace 102 is then be woven in a similar crisscross pattern between the sidewall laces 104 and the outside runner 106, using cross lace knots 116 along the outside runners 106. This step is easily repeated until the cross lace 102 is woven between the remaining outside runner 106 and the outside runners 106 along the full longitudinal length of the head 101. Once this is completed the pocket form 200 can easily be removed by pulling on it until the outer runner guides 204 and the retaining clips 201 release the pocket 100 from the pocket form 200.

What is claimed is:

1. A method of stringing a traditional lacrosse pocket, comprising:

selecting a pocket form with tapered longitudinal edges and a concave shape and depth;

inserting outer runner within retaining spaces running along each longitudinal edge of the pocket form, the retaining spaces defined by outer runner guides and corresponding retaining clips positioned along the longitudinal edges;

inserting inner runners against inner surfaces of inner runner guides extending from an upper surface of the pocket form along its full longitudinal length of the pocket form;

weaving a lacing string through notches running along each of the longitudinal edges and inner cutouts running along the longitudinal center and thereby forming a predefined pattern on each longitudinal side of the pocket form;

knotting the lacing strings to the inner and outer runners along each longitudinal edge at positions defined by corresponding notches and inner cutouts;

connecting the inner runners with a plurality lacing strings running across each of the cutouts;

placing the pocket form within a lacrosse head;

securing an upper end of the inner and outer runners to an upper lateral edge of the lacrosse head;

securing a lower end of the inner and outer runners to a lower lateral edge of the lacrosse head;

weaving the lacing strings through sidewall laces and the outer runners with cross lace knots on the outer runners along each longitudinal edge of the pocket form, the sidewall laces attached to and running along an outer longitudinal edge of the lacrosse head; and detaching the pocket form from the inner and outer runners and removing the pocket form from the lacrosse head.

* * * * *